US007668471B2

(12) United States Patent
Takeuchi et al.

(10) Patent No.: US 7,668,471 B2
(45) Date of Patent: Feb. 23, 2010

(54) IMAGE FORMING APPARATUS AND IMAGE FORMING METHOD

(75) Inventors: Nobutaka Takeuchi, Yokohama (JP); Shin Hasegawa, Zama (JP); Kohta Fujimori, Yokohama (JP); Kayoko Tanaka, Edogawa-ku (JP); Yushi Hirayama, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 451 days.

(21) Appl. No.: 11/748,090

(22) Filed: May 14, 2007

(65) Prior Publication Data

US 2007/0269228 A1 Nov. 22, 2007

(30) Foreign Application Priority Data

May 22, 2006 (JP) ..... 2006-141920

(51) Int. Cl.
*G03G 15/08* (2006.01)

(52) U.S. Cl. ..... 399/30; 399/53; 399/55

(58) Field of Classification Search ..... 399/9, 399/24, 27, 29, 30, 38, 53, 55
See application file for complete search history.

(56) References Cited

U.S. PATENT DOCUMENTS 5,357,317 A * 10/1994 Fukuchi et al. ..... 399/39
5,387,965 A * 2/1995 Hasegawa et al. ..... 399/60
6,181,892 B1 1/2001 Fujimori
6,366,751 B1 4/2002 Shakuto et al.
6,665,511 B2 12/2003 Takeuchi et al.
6,690,896 B2 2/2004 Hanada et al.
6,757,509 B2 6/2004 Shoji et al.
6,819,901 B1 11/2004 Yasutomi et al.
6,823,163 B2 11/2004 Sugimoto et al.
6,856,780 B2 2/2005 Kadota et al.
7,024,141 B2 4/2006 Takeuchi et al.
7,103,305 B2 9/2006 Koike et al.

(Continued)

FOREIGN PATENT DOCUMENTS

JP 57-136667 8/1982

(Continued)

OTHER PUBLICATIONS

U.S. Appl. No. 11/932,198, filed Oct. 31, 2007, Takeuchi, et al.

*Primary Examiner*—Hoan H Tran
(74) *Attorney, Agent, or Firm*—Oblon, Spivak, McClelland, Maier & Neustadt, L.L.P.

(57) ABSTRACT

An image forming apparatus including a latent image bearing member; a developing device configured to develop a latent image on the image bearing member with a two-component developer; a development potential forming device configured to form a development potential; a toner replenishing device configured to supply the toner to the developing device; a toner concentration detecting device configured to detect and output the concentration of the toner in the developer; a toner concentration controlling device configured to compare the toner concentration output with a toner concentration target to control the toner concentration; an information detecting device configured to obtain information to determine the replacement amount of the toner in the developing device in a predetermined period of time; and a development potential correcting device configured to adjust the development potential on the basis of the information obtained by the information detecting device.

16 Claims, 7 Drawing Sheets

U.S. PATENT DOCUMENTS

| | | | | |
|---|---|---|---|---|
| 7,116,932 | B2 | 10/2006 | Takeuchi et al. | |
| 7,127,198 | B2 | 10/2006 | Muramatsu et al. | |
| 7,171,145 | B2 | 1/2007 | Takeuchi et al. | |
| 7,349,653 | B2 * | 3/2008 | Nishihama et al. | 399/223 |
| 7,515,844 | B2 * | 4/2009 | Tanaka et al. | 399/59 |
| 2004/0265015 | A1 | 12/2004 | Koike et al. | |
| 2005/0265759 | A1 | 12/2005 | Takeuchi et al. | |
| 2006/0008281 | A1 | 1/2006 | Matsumoto et al. | |
| 2007/0036566 | A1 | 2/2007 | Takeuchi et al. | |
| 2007/0053703 | A1 | 3/2007 | Hirayama | |

FOREIGN PATENT DOCUMENTS

| | | |
|---|---|---|
| JP | 2-34877 | 2/1990 |
| JP | 11-327281 | 11/1999 |
| JP | 2000-181155 | 6/2000 |
| JP | 2002-40725 | 2/2002 |
| JP | 2004-101564 | 4/2004 |

* cited by examiner

IMAGE FORMING APPARATUS AND IMAGE FORMING METHOD

BACKGROUND OF THE INVENTION

1. Field of the Invention

The present invention relates to an image forming apparatus, and more particularly to an image forming apparatus which forms images using a two-component developer including a toner and a carrier. In addition, the present invention also relates to an image forming method.

2. Discussion of the Background

Electrophotographic image forming methods are well known and typically include the following processes.

(1) An electrostatic latent image is formed on an image bearing member (latent image forming process);

(2) The electrostatic latent image is developed with a developer including a toner to form a toner image on the image bearing member (developing process);

(3) The toner image is transferred onto a receiving material optionally via an intermediate transfer medium (transfer process); and (4) The toner image on the receiving material is fixed thereto, for example, upon application of heat and pressure thereto (fixing process).

The developing process is typically performed using a two-component developing method or a one-component developing method. Two-component developing methods use a two-component developer including a toner and a carrier. Specifically, an electrostatic image formed on an image bearing member is rubbed with a magnetic brush of a two-component developer, which includes a toner and a magnetic carrier and which is formed on a developer bearing member, resulting in formation of a toner image on the image bearing member. The magnetic brush is formed by a magnet (i.e., a magnetic pole) provided in the developer bearing member. Such two-component developing methods are typically used for electrophotographic image forming apparatuses because of being able to easily produce color images.

When the toner concentration (i.e., the weight ratio (T/C) of the toner to the carrier) is too high in a two-component developer, a background development problem in that the background portion of an image is soiled with toner particles, and a problem in that the resolution of fine images deteriorates tend to occur. In contrast, when the toner concentration is too low, a low density problem in that produced toner images have a low image density, a carrier adhesion problem in that not only toner particles but also carrier particles are adhered to an electrostatic latent image formed on an image bearing member tend to occur. Therefore, it is important to control the concentration of the toner in a two-component developer so as to fall within a proper toner concentration range. In order to control the concentration of the toner, a toner concentration controlling method such that the toner concentration in a developer is checked, and a toner replenishing operation is properly performed depending on the toner concentration is used.

It is important for an image forming apparatus that produced images have a constant image density. The image density of images produced by an image forming apparatus mainly depends on the developing ability of the developing device of the image forming apparatus. Specifically, the developing ability of a developing device is defined as the weight of a toner adhered to an electrostatic image having a predetermined potential by the developing device. The developing ability depends on the concentration of the toner in the developer used; developing conditions such as the development potential which is the difference between the potential of an electrostatic image and the development bias applied to the developer bearing member; and the quantity of charge of the toner used. It is well known that the developing ability of a developing device is represented by the slope (development gamma characteristic $\gamma$) of a relationship equation between development potentials and weights of toner particles adhered to an electrostatic image.

Thus, the image density of images produced by an image forming apparatus depends on the developing ability of the developing device thereof. Therefore, the image density cannot be controlled by merely controlling the concentration of the toner in the developer used. Specifically, the development conditions such as development potential can be controlled relatively easily, but it is difficult to control the charge quantity of the toner used for development. Therefore, it is difficult to control the developing ability (i.e., the image density) by merely controlling the development conditions and the toner concentration.

For example, when images with a low image area proportion are produced, only a small amount of toner particles are consumed for forming the images. Therefore, a small amount of new toner particles are replenished to the developing device. In other words, almost all the toner particles in the developing device are staying therein for a long period of time while agitated. Therefore, almost all the toner particles are fully charged and have a desired charge quantity. In this case, the developing ability of the developing device is relatively low. In contrast, when images with a high image area proportion are produced, a large amount of toner particles are consumed for forming the images, and therefore a large amount of new toner particles are present in the developing device, which have a charge quantity lower than the desired charge quantity. In this case, the developing ability of the developing device is relatively high.

In recent years, a need exists for small-sized image forming apparatus and developing devices. Therefore, the amount of toner particles contained in such a small-sized developing device is small. Therefore, after production of images with a high image area proportion, toner particles in the developing device are not sufficiently charged. In this case, the developing device has a relatively high developing ability.

However, it is possible that a developing device has a higher developing ability after production of images with a low image area proportion than in a case where images with a high image area proportion are produced. For example, when a toner in which an external additive is adhered to toner particles is used and the toner is agitated for a long period of time in a developing device while receiving a high stress, problems in that the external additive is embedded into the toner particles or released therefrom tend to occur. In this case, the fluidity and charging ability of the toner deteriorate, and therefore the toner particles staying in the developing device for a long period of time have a low charge quantity. Therefore, after production of images with a low image area proportion, a large amount of toner particles having a low charge quantity are present in the developing device, and the developing device has a high developing ability. In contrast, after production of images with a high image area proportion, the developing device has a low developing ability because of including a large amount of new toner particles, which have good fluidity and charging ability. In this case, the new toner particles can be easily charged and have a desired charge quantity. Therefore, the developing device has a relatively low developing ability.

Thus, the content of new toner particles in a developing device changes depending on the image area proportion of the produced images, resulting in change of the developing ability of the developing device. Therefore, even when the development conditions of a developing device and the toner concentration are controlled so as to be constant, the developing ability of the developing device cannot be controlled so as to be constant, resulting in occurrence of a problem in that images with a constant image density cannot be produced.

In attempting to solve the problem, published unexamined Japanese patent applications Nos. 57-136667 and 02-034877 have disclosed image forming apparatuses having a toner concentration detecting device. In the image forming apparatuses, the toner concentration detecting device detects the concentration of toner in the two-component developer contained in the developing device and outputs the toner concentration data. The image forming apparatuses compare the toner concentration data with the target of the toner concentration to control the toner replenishing device on the basis of the comparison result so that the concentration of toner in the two-component developer contained in the developing device approaches the toner concentration target. In addition, the image forming apparatuses form a reference toner image on a non-image area of the image bearing member thereof and measure the image density of the reference toner image to correct the toner concentration target on the basis of the image density of the toner image.

By using this method, it is possible to produce images having a constant image density for a while after correction of the toner concentration target. Therefore, by performing the reference toner image formation operation and the toner concentration target correction operation at regular intervals, it will be possible to produce images having a constant image density. However, this method has a drawback in that whenever the toner concentration correction operation is performed, a reference toner image has to be formed, resulting in increase of the toner consumption.

Because of these reasons, a need exists for an image forming apparatus which can produce images having a constant image density without increasing toner consumption.

SUMMARY OF THE INVENTION

As an aspect of the present invention, an image forming apparatus is provided which includes:

a latent image bearing member configured to bear an electrostatic latent image thereon;

a developing device configured to develop the latent image with a two-component developer including a toner and a magnetic carrier, wherein the developing device includes a developer bearing member bearing the two-component developer on a surface thereof;

a development potential forming device configured to form a development potential between the electrostatic latent image on the image bearing member and the developer bearing member;

a toner replenishing device configured to supply the toner to the developing device;

a toner concentration detecting device configured to detect and output the concentration of the toner in the two-component developer in the developing device;

a toner concentration controlling device configured to compare the toner concentration output with a toner concentration target to control the toner concentration so as to approach the toner concentration target;

an information detecting device configured to obtain information to determine the replacement amount of the toner in the developing device in a predetermined period of time; and a development potential correcting device configured to adjust the development potential on the basis of the information obtained by the information detecting device.

Another aspect of the present invention, an image forming method is provided which includes:

forming an electrostatic latent image on an image bearing member;

developing the electrostatic latent image with a two-component developer including a toner and a magnetic carrier using a developer bearing member while applying a development potential between the electrostatic latent image on the image bearing member and the developer bearing member determining a concentration of the toner in the two-component developer;

comparing the toner concentration with a toner concentration target;

controlling the toner concentration on the basis of the comparison result so as to approach the toner concentration target;

obtaining information to determine a replacement amount of the toner in the developer; and adjusting the development potential on the basis of the information.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
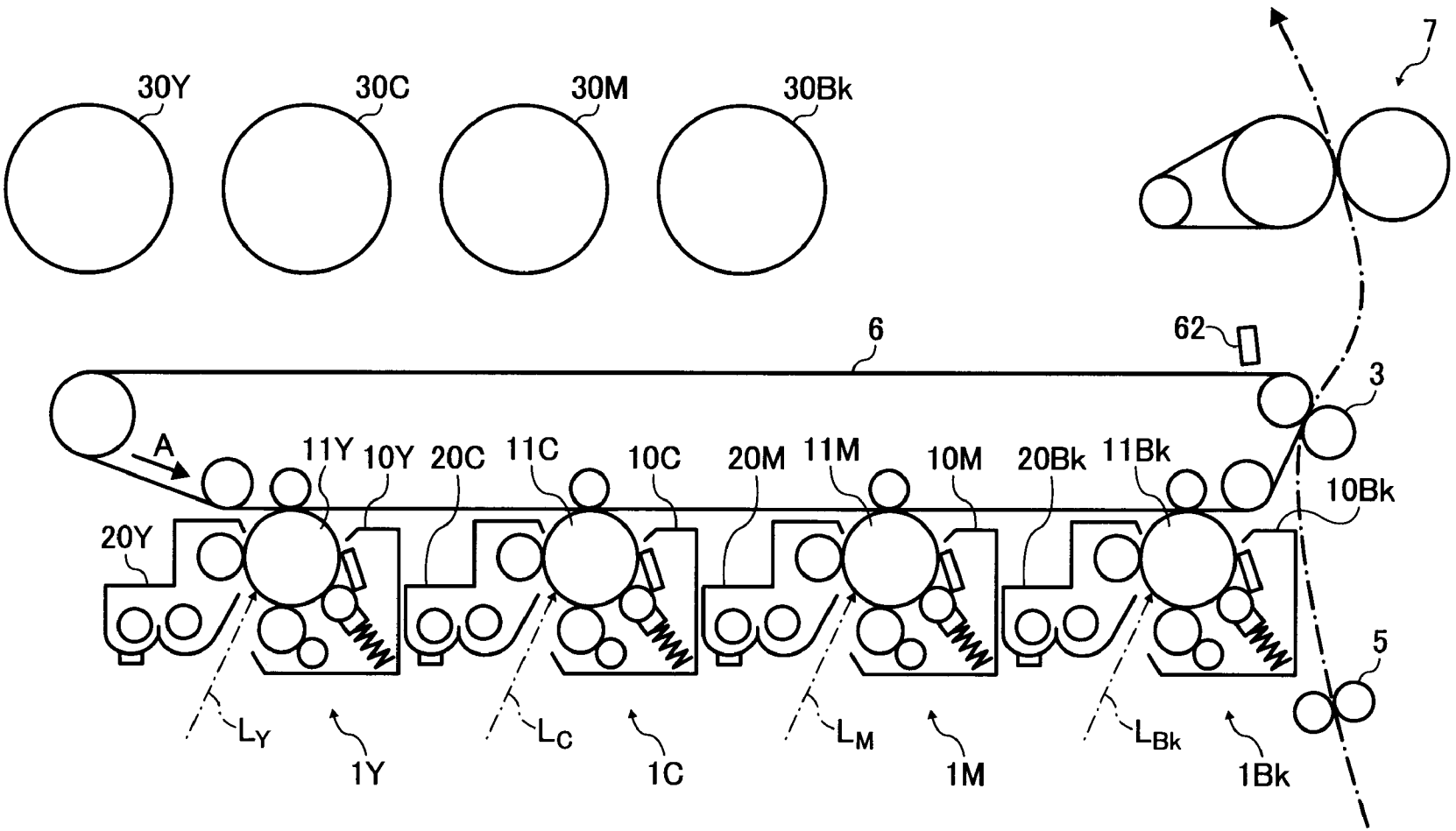
FIG. 1 is a schematic view illustrating a main portion of an example (a color printer) of the image forming apparatus of the present invention.

In order to solve the above-mentioned problem, the present inventors have proposed an image forming apparatus. Specifically, the image forming apparatus includes an information detecting device, which obtains information (such as image area proportion of produced images) to determine the replacement amount of the toner in the two-component developer contained in the developing device. The image forming apparatus can determine the content of new toner (or old toner) in the developer contained in the developing device (i.e., to determine the developing ability of the developing device) on the basis of the information obtained by the information detecting device. In addition, the image forming apparatus includes a toner concentration target correction device, which corrects the toner concentration target on the basis of the information obtained by the information detecting device to produce images having a constant image density. Since the replacement amount of toner can be determined without using the toner, occurrence of the toner consumption increasing problem can be prevented.

In this image forming apparatus, the toner concentration target is changed on the basis of the information obtained by the information detecting device to control the image density to be constant. In order to increase the toner concentration, the toner is replenished. In this case, the image density of images can be quickly controlled. In order to decrease the toner concentration, replenishing of the toner is suppressed so that the toner concentration decreases with time (i.e., with production of images). Therefore, it takes a relatively long time until the image density becomes to the target.

As mentioned above, it is necessary to determine the content of new toner (or old toner) in the developing device to produce images having a constant image density. In the present application, information is obtained to determine the replacement amount of toner in the developing device within a predetermined period. From this information, the amounts of the consumed toner and added toner (i.e., the content of new toner (or old toner)) can be determined and thereby the developing ability of the developing device can be determined. On the basis of the information, the development potential correcting device corrects the development potential. By adjusting the development potential (i.e., by adjusting the potential difference between an electrostatic image on the image bearing member and the developer bearing member to which a development bias is applied), the amount of toner adhered to an electrostatic image can be changed. Therefore, the image density can be quickly changed. Even when the image area proportion of images is changed and thereby the replacement amount of toner is changed, the image density can be controlled to be constant by adjusting the development potential. In addition, the information can be obtained without consuming the toner, and therefore the toner consumption increasing problem can be avoided.

Next an example (a color laser printer) of the image forming apparatus of the present invention will be explained with reference to drawings.

FIG. 1 is a schematic view illustrating the main portion of the image forming apparatus (hereinafter referred to as a laser printer).

The laser printer has four image forming devices 1Y, 1C, 1M and 1Bk, which respectively form yellow (Y), cyan (C), magenta (M) and black (Bk) color images and which are arranged from an upstream side to a downstream side relative to the moving direction (indicated by an arrow A) of an intermediate transfer belt 6 serving as an intermediate transfer medium. Each of the four image forming devices 1Y, 1C, 1M and 1Bk has a photoreceptor unit 10Y, 10C, 10M or 10Bk including a photoreceptor drum 11Y, 11C, 11M or 11Bk, which serves as an image bearing member; and a developing device 20Y, 20C, 20M and 20Bk. The image forming devices 1Y, 1C, 1M and 1Bk are arranged at regular intervals in the direction (A) while the photoreceptor drums 11Y, 11C, 11M and 11Bk are set such that the rotation axes thereof are parallel to each other.

The image forming devices 1Y, 1C, 1M and 1Bk form respective color toner images on the respective photoreceptor drums 11Y, 11C, 11M and 11Bk. The color toner images are transferred one by one onto the intermediate transfer belt 6 so as to be overlaid. The color toner images thus overlaid on the intermediate transfer belt 6 are transported to a secondary transfer nip formed by the intermediate transfer belt 6 and a secondary transfer roller 3.

The image forming apparatus illustrated in FIG. 1 also has an optical writing unit, which is not illustrated in FIG. 1 but is located under the image forming devices and which irradiates the photoreceptor drums with respective imagewise light beams $L_Y$, $L_C$, $L_M$ and $L_{Bk}$ to form electrostatic latent images on the photoreceptor drums to be developed by the developing device; and a receiving material feeding cassette, which is not illustrated in FIG. 1 but is located under the optical writing unit.

A sheet of a receiving material is fed along a chain line. Specifically, an uppermost sheet of the receiving material in the cassette is fed by plural feed rollers while guided by a feeding guide (not shown). The thus fed sheet is stopped once at a pair of registration rollers 5, and is timely fed to the secondary transfer nip such that the color toner images on the intermediate transfer belt 6 are transferred to a proper position of the sheet. The sheet bearing the color toner images thereon is fixed by a fixing device 7. The sheet bearing a fixed color image is discharged to a discharge tray (not shown).

In FIG. 1, numerals 30Y, 30C, 30M and 30Bk represent yellow, cyan, magenta and black toner cartridges, respectively.

Figure 2:
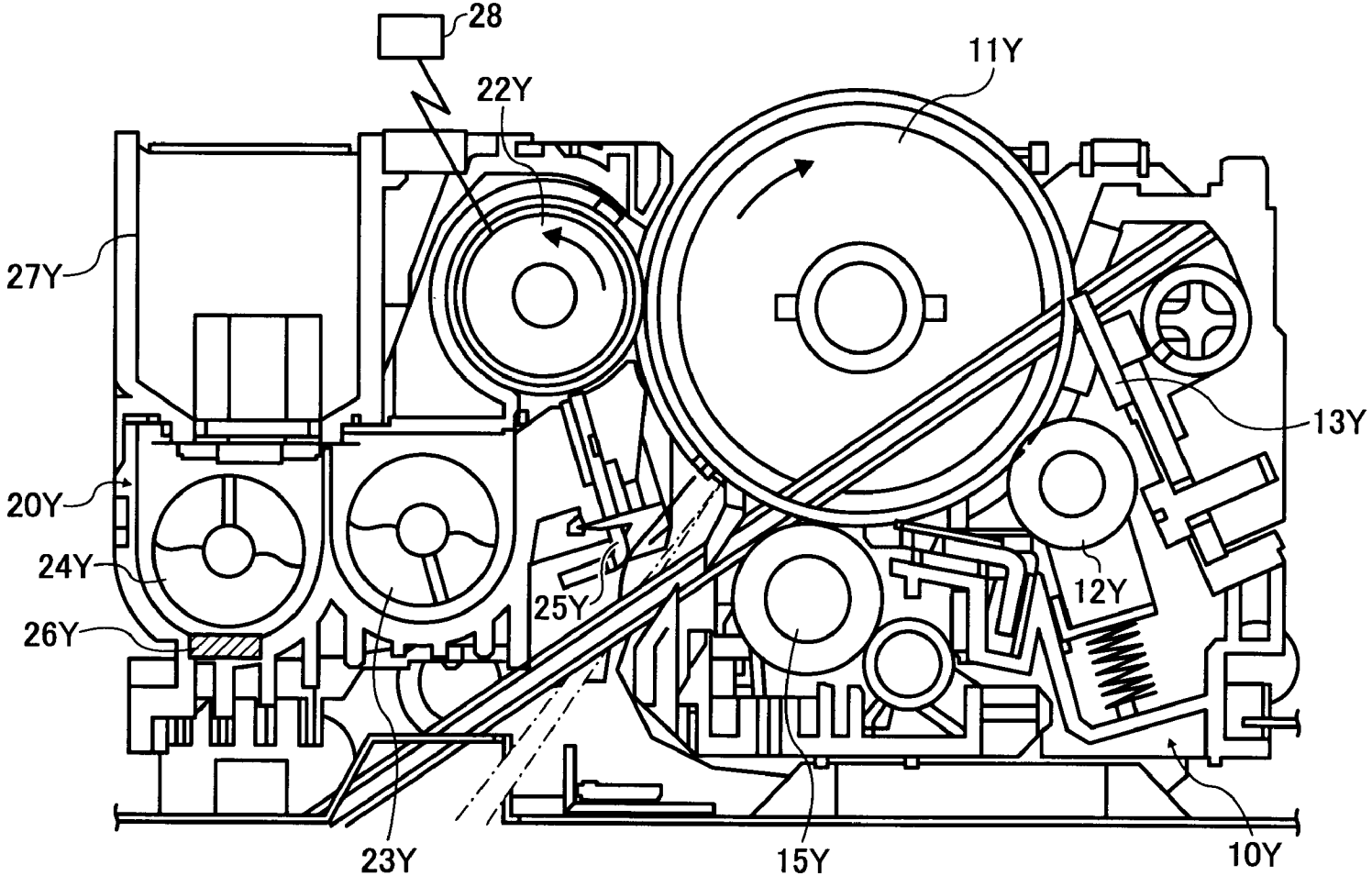
FIG. 2 is a schematic view illustrating one of the four image forming devices of the image forming apparatus illustrated in FIG. 1.

FIG. 2 is a schematic view illustrating the image forming device 1Y. Since the four image forming devices have substantially the same structure, only one (the image forming device 1Y) of the image forming devices will be explained.

Referring to FIG. 2, the image forming device 1Y includes the photoreceptor unit 10Y including the photoreceptor drum 11Y configured to bear an electrostatic image thereon; and the developing device 20Y configured to develop the electrostatic image with a yellow color toner to form a yellow color toner image on the photoreceptor drum 11Y. The photoreceptor unit 10Y includes the photoreceptor drum 11Y; a cleaning blade 13Y configured to clean the surface of the photoreceptor drum 11Y; a charging roller 15Y configured to uniformly charge the surface of the photoreceptor drum 11Y; and a lubricant application brush roller 12Y, which applies a lubricant to the surface of the photoreceptor drum 11Y and which also serves as a discharger configured to discharge the charges remaining on the photoreceptor drum even after an image transfer operation. The brush of the lubricant application brush roller 12Y includes a metal core and a brush, which is formed on the metal core and includes electroconductive fibers. The metal core is connected with a power source (not shown) used for discharging.

The image forming operation of the image forming device 1Y is as follows. At first, the surface of the photoreceptor drum 11Y is uniformly charged by the charging roller 15Y to which a voltage is applied. The laser light beam $L_Y$ emitted by the optical writing unit (not shown) after modulation and deflection irradiates the charged photoreceptor drum 11Y, resulting in formation of an electrostatic image thereon. The thus formed electrostatic image is developed with the developing device 20Y (explained below), resulting in formation of a yellow toner image thereon. The yellow toner image is then transferred to the intermediate transfer belt 6 at a primary transfer nip in which the photoreceptor drum 11Y faces the intermediate transfer belt 6. After the primary transfer operation, the cleaning blade 13Y cleans the surface of the photoreceptor drum 11Y, and the lubricant application brush roller 12Y applies a lubricant to the surface of the photoreceptor drum 11Y while discharging the photoreceptor drum. Thus, the photoreceptor drum 11Y becomes ready for the next image forming operation.

The developing device 20Y uses, as a developer, a two-component developer including a magnetic carrier and a negatively charged yellow toner. The developing device 20Y includes a rotatable developing sleeve 22Y (serving as a developer bearing member, which is made of a non-magnetic material and has therein a fixed magnet roller (not shown, serving as a magnetic field generating member) and which is arranged so as to be partially exposed to the photoreceptor while projected from an opening of a case of the developing device. Further, the developing device 20Y includes agitation screws 23Y and 24Y configured to agitate the developer in the developing device; a development doctor 25Y configured to form a developer layer having a uniform thickness on the developing sleeve 22Y; a magnetic permeability sensor 26Y serving as a toner concentration detecting device; and a powder pump 27Y serving as a toner replenishing device configured to feed the toner.

A development bias, e.g., a negative DC voltage (DC component) overlapped with an AC voltage (AC component), is applied to the developing sleeve 22Y by a development bias power source 28 serving as a development potential forming device so that the developing sleeve 22Y is biased so as to have a predetermined voltage relative to the metal substrate of the photoreceptor drum 11Y. In this regard, only a negative component (a negative DC voltage) may be applied as a development bias.

Referring to FIG. 2, the developer in the case of the developing device 20Y is agitated by the agitation screws 23Y and 24Y, and thereby the developer is frictionally charged. Part of the developer in a first agitation passage, in which the first agitation screw 23Y is arranged, is borne on the surface of the developing sleeve 22Y. The developer on the developing sleeve 22Y is scraped with the development doctor 25Y to form a developer layer having a constant thickness on the sleeve. The developer layer is then fed to a developing region in which the developing sleeve 22Y faces the photoreceptor drum 11Y. In the developing region, the toner in the developer layer on the developing sleeve 22Y is adhered to an electrostatic image by the influence of the development electric field formed by the development bias, resulting in formation of a toner image on the photoreceptor drum 11Y. The developer, which passes the developing region and is further fed, is separated from the surface of the developing sleeve at a release position in which the magnetic roller in the developing sleeve has no magnetic pole or the same magnetic poles (N-N or S-S) are adjacent to each other, to be returned to the first agitation passage. The developer thus fed to the downstream side of the first agitation passage is then fed to the upstream side of a second agitation passage in which the second agitation screw 24Y is arranged. The developer receives new toner in the second agitation passage. The developer thus receiving new toner is then fed to the upstream side of the first agitation passage via the downstream side of the second agitation passage. The magnetic permeability sensor 26Y is provided on a portion of the case of the developing device 20Y, which constitutes the bottom of the second agitation passage.

When toner images are formed, the toner in the developer in the case of the developing device is consumed, resulting in decrease of the concentration of toner in the developer. The magnetic permeability sensor 26Y measures the toner concentration and outputs the measurement data (i.e., a voltage Vt, hereinafter referred to as an output Vt). On the basis of the output Vt output from the magnetic permeability sensor 26Y, the toner in the toner cartridge 30Y (in FIG. 1) is fed by the powder pump 27Y to the developing device to control the toner concentration in the developer so as to fall in the proper range. Specifically, when the difference Tn ($=Vt_{ref}-Vt$) between a toner concentration target $Vt_{ref}$ and the output Vt is positive (i.e., greater than zero), the toner concentration is high, and therefore the toner is not replenished. In contrast, when the difference Tn is negative (i.e., less than zero), the toner is replenished because the toner concentration is low. In this regard, the greater the absolute value of the difference Tn, the greater the amount of the replenished toner. Thus, the toner concentration is controlled so as to approach the toner concentration target $Vt_{ref}$.

In addition, it is preferable that at regular intervals (for example, every 10 (a number of from 5 to 200) copies, which is determined depending on the copy speed, etc.), process conditions such as the toner concentration target $Vt_{ref}$, the potential of the charged photoreceptor drum, and the light quantity of the laser beam used for forming electrostatic images are adjusted. Specifically, for example, the optical densities of half tone images or solid images, which are formed on photoreceptor and then transferred to the intermediate transfer belt 6, are measured with a reflection density sensor 62 illustrated in FIG. 1. The process conditions (i.e., the toner concentration target $Vt_{ref}$, potential of the charged photoreceptor drum, light quantity of the laser beam, etc.) are adjusted on the basis of the optical densities. Further, in this example a development potential correction operation is performed every image forming operation. The details of the development potential correction operation will be explained below.

Among the four photoreceptor drums 11Y, 11C, 11M and 11Bk, only the photoreceptor drum 11Bk, which is located on the downmost stream side is always contacted with the intermediate transfer belt 6. The other photoreceptor drums can be contacted with and separated from the intermediate transfer belt 6. When a multi-color image is formed, all the four photoreceptor drums are contacted with the intermediate transfer belt 6. When a black color image is formed, only the photoreceptor drum 11Bk is contacted with the intermediate transfer belt 6 and the other photoreceptor drums are separated therefrom.

Next, a controller serving as a controlling device for controlling the toner concentration will be explained.

Figure 3:
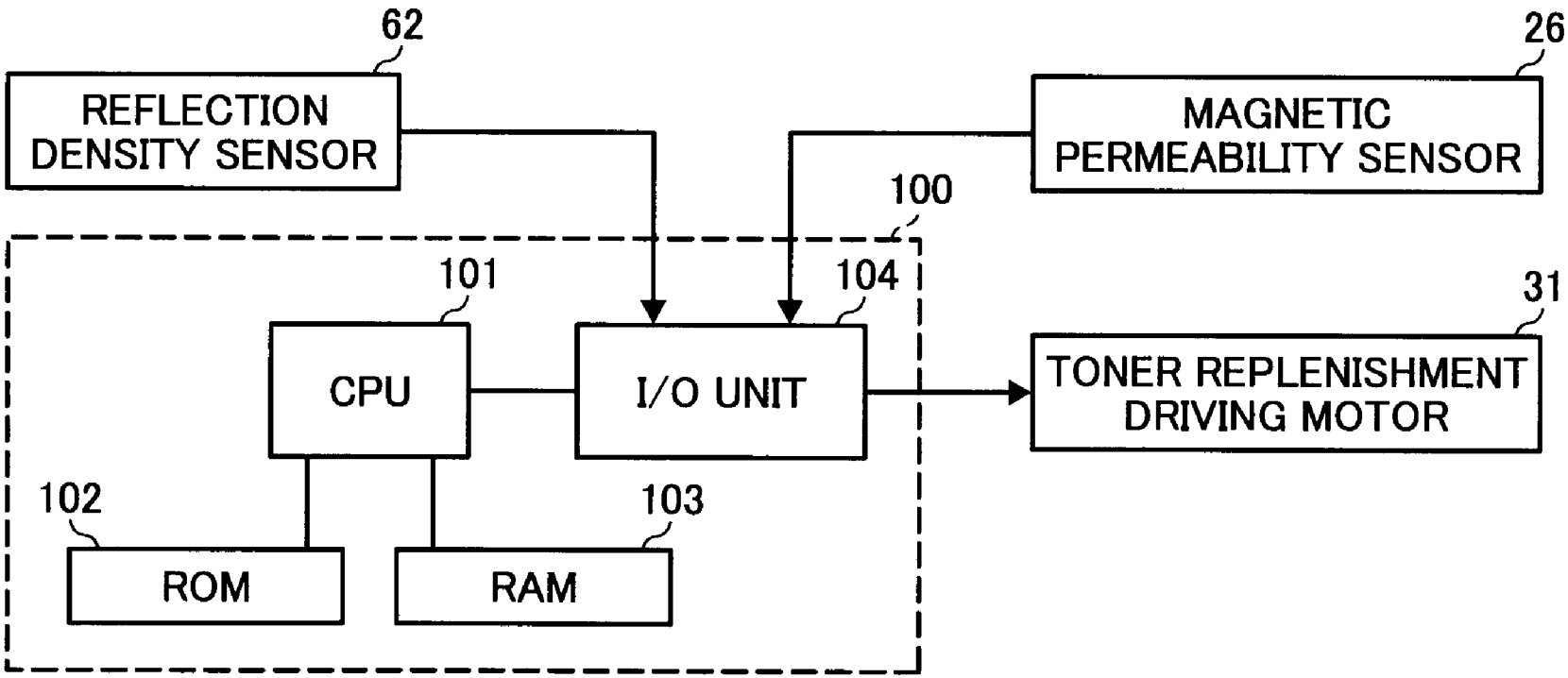
FIG. 3 is a schematic view illustrating a controller of the image forming apparatus, which controls the concentration of the toner in the developer.

FIG. 3 is a schematic view illustrating a controller 100 for controlling the toner concentration. The controller 100 is provided in each developing device 20Y, 20C, 20M or 20Bk except that some parts of the controller (i.e., a CPU 101, a ROM 102, a RAM 103, etc.) are shared by the four developing devices. The controller 100 includes the CPU 101, ROM 102, RAM 103, an I/O unit 104, etc. The I/O unit 104 is connected with each of the magnetic permeability sensor 26 and the reflection density sensor 62 via an A/D converter (not shown).

In the controller 100, the CPU 101 executes a predetermined toner concentration control program and sends a control signal to a toner replenishment driving motor 31, which drives the powder pump 27 through the I/O unit 104, to control the toner replenishment operation. Further, the CPU 101 executes a predetermined toner concentration target correction program to correct the toner concentration target $Vt_{ref}$ so that the concentration of the toner in the developer is controlled so as to be constant. Furthermore, the CPU 101 executes a predetermined development potential correction program to correct the development potential every image forming operation so that the concentration of the toner in the developer is controlled so as to be constant.

The ROM 102 stores the programs that the CPU 101 executes, such as the toner concentration control program, and the image density control parameter correction programs (e.g., the toner concentration target correction program and the development potential correction program). The RAM 103 includes a Vt register configured to temporarily store the output Vt obtained from the magnetic permeability sensor 26 through the I/O unit 104; a $Vt_{ref}$ register configured to store the toner concentration target $Vt_{ref}$, i.e., the reference output value that the magnetic permeability sensor 26 should output when the toner concentration in the developer is equal to the targeted toner concentration; a Vs register configured to store the output Vs output from the reflection density sensor 62.

Figure 4:
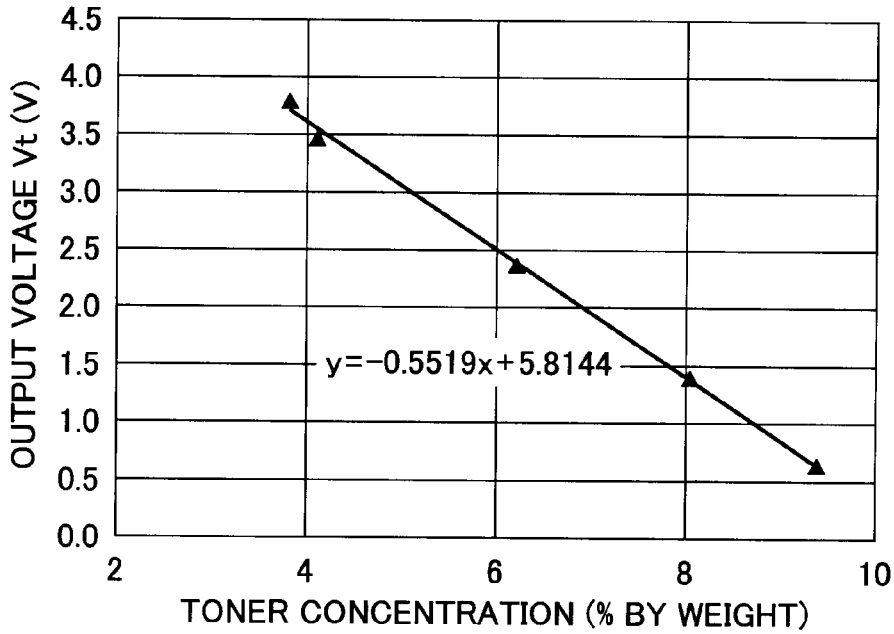
FIG. 4 is a graph illustrating the relationship between the toner concentration and the output of a magnetic permeability sensor.

FIG. 4 is a graph illustrating the relationship between the toner concentration in units of % by weight and the output Vt in units of volt of a magnetic permeability sensor. It is clear from the graph that in a practical toner concentration range, the output voltage Vt from the magnetic permeability sensor 26 is proportional to the toner concentration, and the higher the toner concentration, the lower the output voltage Vt. By using this characteristic, the toner concentration can be controlled. Specifically, when the output voltage Vt is greater than the toner concentration target $Vt_{ref}$, the powder pump 27 is driven to replenish the toner to the developing device. In this example, the toner replenishment controlling operation is performed every image forming operation on the basis of the output voltage Vt from the magnetic permeability sensor 26.

Next, the development potential correction operation will be explained in detail.

Figure 5:
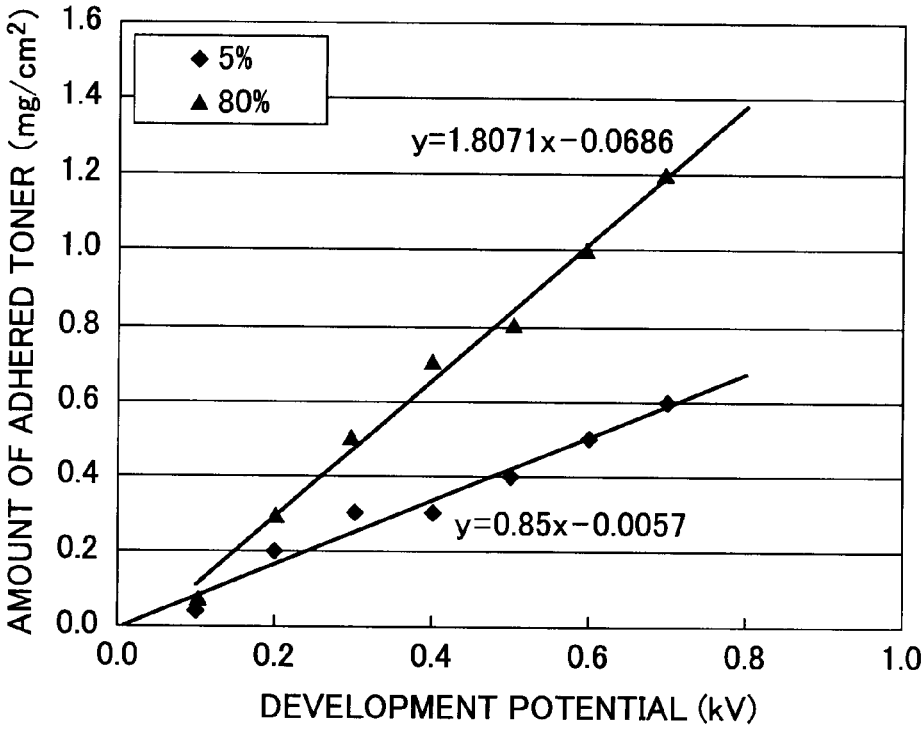
FIG. 5 is a graph illustrating the relationship (i.e., the development gamma characteristic $\gamma$) between the development potential and the amount of toner adhered to an electrostatic image when the image area proportion is parameterized.

FIG. 5 is a graph illustrating the relationship (i.e., the development gamma characteristic γ) between the development potential and the amount of toner adhered to an electrostatic image while the image area proportion is parameterized. This graph is obtained by performing experiments (i.e., measuring the development gamma characteristic) after running tests in which 100 copies of each of two original images having a constant image area proportion of 5% or 80% are continuously produced at a normal linear velocity (138 mm/sec). It is clear from FIG. 5 that after images with a high image area proportion are produced, the development gamma characteristic γ of the developer is higher than in the case where images with a low image area proportion are produced. The reason therefor is considered to be as follows.

When images with a high image area proportion are produced, the replacement amount of the toner in a predetermined period of time is relatively high. In other words, the amount of old toner particles, which have been staying in the developing device 20 for a long period of time and are excessively charged, is relatively small. Therefore, the developing device has a higher developing ability than in the case where images with a low image area proportion are produced.

Thus, the developing ability of toner changes depending on the replacement amount of the toner in a developing device. When the developing ability changes, the image density of the produced images also changes, resulting in occurrence of an image density problem in that images with a constant image density cannot be produced. In the present invention, the development potential is corrected to prevent occurrence of the image density problem even when the replacement amount of the toner changes.

The replacement amount of toner in a predetermined period of time can be obtained from various information such as the area (in units of $cm^2$) of image portions of the produced images or the image area proportion (%) of the produced images. In this example, the replacement amount of toner is obtained from the information on the image area proportion. In this example, the image area proportion (%) is converted to a toner replacement amount (mg/page). Specifically, when the developer has a normal developing ability, and an A-4 size solid image with an image area proportion of 100% is output, 300 mg of the toner is consumed while 300 mg of new toner is replenished. In this case, the toner replacement amount is 300 mg/page. When the image area proportion is converted to the toner replacement amount in a case where receiving sheets with various sizes are used for forming images, the image area proportion data should be calculated after the various receiving sheets are converted to the standard receiving sheet (for example, an A-4 size sheet in a landscape orientation). In this example, the developing device 20 contains 240 g of the developer.

Figure 6:
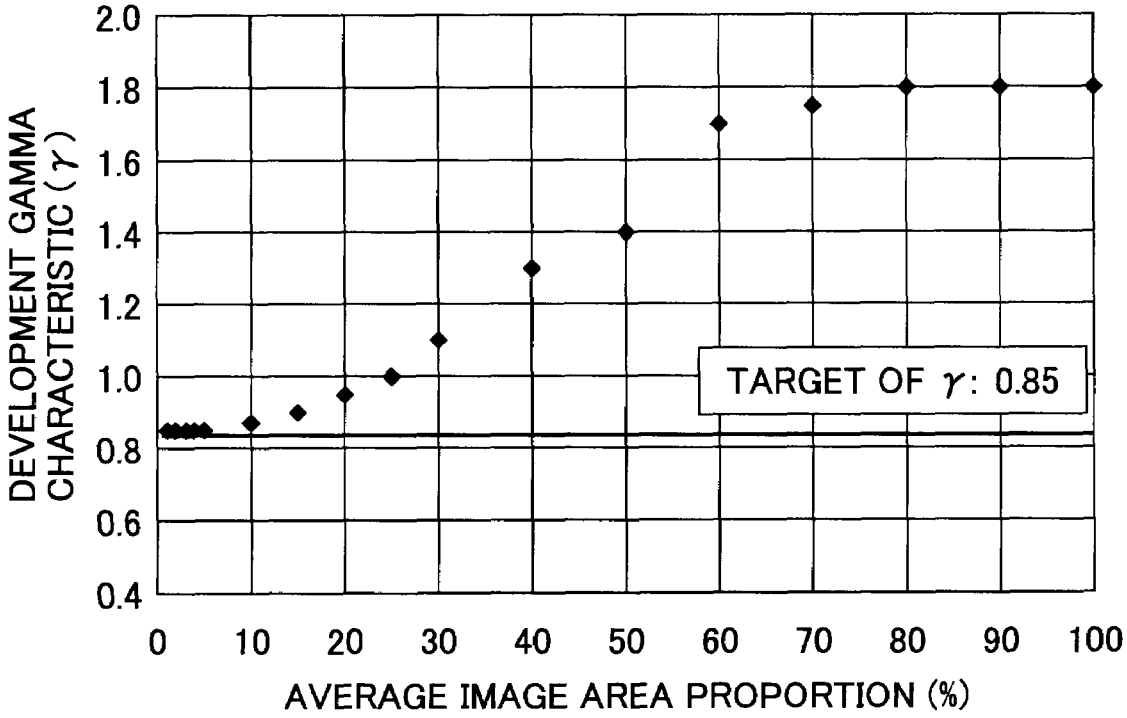
FIG. 6 is a graph illustrating the relationship between the image area proportion and the development gamma character $\gamma$.

FIG. 6 is a graph illustrating the relationship between the average image area proportion (%) of the images produced by a developer and the development gamma characteristic γ (in units of $mg/cm^2/kV$) of the developer. Similarly to the graph illustrated in FIG. 5, this graph is obtained by performing running tests in which 100 copies of each of various original images having a constant image area proportion of from 0% to 100% are continuously produced at a normal linear velocity (138 mm/sec). It is clear from FIG. 6 that when the image area proportion is greater than the standard image area proportion (i.e., 5%), the development gamma characteristic γ increases. Therefore, when the image area proportion is greater than 5%, the development potential is decreased to decrease the development gamma characteristic γ. In contrast, when the image area proportion is not greater than the standard image area proportion (i.e., 5%), the development potential is preferably increased to control the image density to be constant (the development potential is increased such that the development gamma characteristic is changed in a degree of about 0.05).

Figure 7:
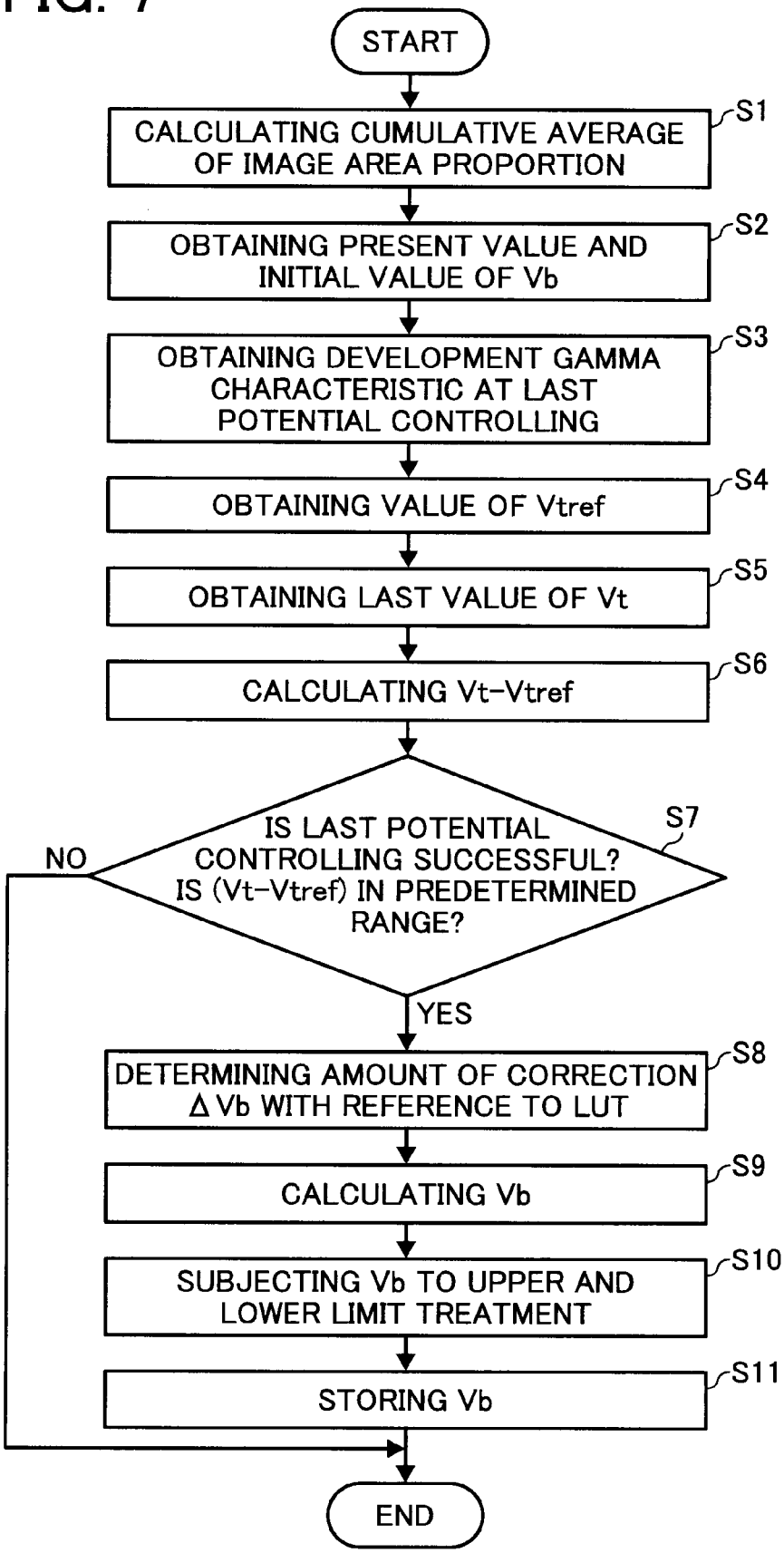
FIG. 7 is a flowchart illustrating flow of the development potential correction operation of the image forming apparatus of the present invention.

Next, the development potential correction operation on the basis of the image area proportion will be explained with reference to a flowchart illustrated in FIG. 7.

In this example, correction of the development potential is performed by adjusting the development bias. In addition, the development potential correction operation is started after completion of each printing job. At first, the average of the image area proportions of the produced images is calculated (Step S1). In order to calculate the average of the image area proportions, the image area proportion (%) of each of the produced images is calculated. When performing this correction operation, it is acceptable that the image area proportions of the produced images are averaged from a certain time (for example, from a time when the last potential control operation is performed). However, it is preferable to determine the moving average of the image area proportions in a predetermined period of time. By using the moving average, the history of the toner replacement amount can be well determined and thereby the characteristics of the developer at the present time can be properly determined. In the present application, the moving average of the image area proportion is determined by the following equation (1).

$$M(i)=(1/N)\times\{(M(i-1)\times(N-1)+X(i)) \quad (1)$$

wherein M(i) represents the present value of the moving average of the image area proportion; M(i−1) represents the last value of the moving average of the image area proportion; N represents the cumulative number of the images produced; and X(i) represents the image area proportion of the present image. In this regard, each of M(i) and X(i) is calculated for each color image.

In this example, only the data of the last moving average of the image area proportion is stored in the RAM 103 (namely, it is not necessary to store therein the data of the image area proportions of all the images (for example, tens of images or more) which have been produced from a time when the last potential control operation is performed). Therefore, the area of the RAM used for storing the data can be dramatically reduced. In addition, it is preferable to change the preset value of the cumulative number (N) of images depending on changes of the environmental conditions and the period of service of the image forming apparatus in order to effectively control the image density.

After the moving average of the image area proportion is calculated, the present value and initial value of the development bias Vb are obtained (Step S2). Next, the development gamma characteristic γ at the last potential controlling operation is obtained (Step S3). In this regard, the potential controlling is performed every 200 copies. Further, the present value of the toner concentration target $Vt_{ref}$ is obtained (Step S4) and the last value of the output Vt of the magnetic permeability sensor is obtained (Step S5) to calculate the difference ($Vt-Vt_{ref}$) (Step S6). Next, it is decided whether or not to perform the correction operation depending on the information thus collected and calculated (Step S7). It is preferable that the decision is performed depending on whether the last potential controlling is successful and/or whether the difference ($Vt-Vt_{ref}$) falls in a predetermined range (for example, ±0.2V). When it is decided that any correction operation is not performed, the development potential correction operation is ended.

When it is decided that the correction operation is performed, the correction value ΔVb of the development potential is determined with reference to a look-up table (LUT) (Step S8). One example of the look-up table is as follows.

TABLE 1

| Cumulative average of image area proportion (%) | Δ γ | Δ Vb |
|---|---|---|
| 0 | −0.05 | 31 |
| 1 | −0.03 | 18 |
| 2 | −0.02 | 12 |
| 3 | 0 | 0 |
| 4 | 0 | 0 |
| 5 | 0 | 0 |
| 6 | 0 | 0 |
| 7 | 0 | 0 |
| 8 | 0 | 0 |
| 9 | 0.02 | −11 |
| 10 | 0.03 | −17 |
| 20 | 0.1 | −52 |
| 30 | 0.25 | −112 |
| 40 | 0.45 | −171 |
| 50 | 0.55 | −194 |
| 60 | 0.85 | −247 |
| 70 | 0.9 | −254 |
| 80 | 0.95 | −261 |
| 90 | 0.95 | −261 |
| 100 | 0.95 | −261 |

In this example, the center of the image area proportion is considered to be 5%. When the cumulative average of the image area proportion deviates from the center, the development potential correction operation is performed. However, the correction operation is not limited thereto, and a correction method in which only when the cumulative average is much lower or higher than the center, the development potential correction operation is performed can also be used. Specifically, there is a case where depending on the properties of the developer used, it is not necessary to correct the development potential when the cumulative average is lower the center.

The correction value ΔVb of the development potential is determined as follows. At first, on the basis of the thus determined moving average of the image area proportion, the deviance Δγ of the development gamma characteristic γ can be obtained. Next, the deviance is converted to the correction value ΔVb of the development potential using the following equation (2).

$$\Delta Vb=\{\Delta\gamma/(\gamma 1\times\gamma 2)\}\times M \quad (2)$$

Wherein γ1 is the development gamma characteristic which is measured in the last potential controlling operation; γ2 is the development gamma characteristic which can be predicted on the basis of the cumulative average of the image area proportion; and M represents the target of the amount of toner of a toner image formed on the intermediate transfer belt.

As shown in Table 1, when the image area proportion is not greater than 10%, the image area proportion is changed at intervals of 1% while the image area proportion is changed at intervals of 10% when the image area proportion is greater than 10%. However, the intervals are not limited thereto, and can be set to proper intervals depending on the conditions of the developer and developing device used.

When plural color developers are used, the correction values ΔVb of the development potentials therefor are preferably determined by the following formula (3).

$$\Delta Vb\ (\text{for each color})=\Delta Vb(\text{above-obtained})\times C \quad (3)$$

wherein C represents the color correction coefficient for the color.

After the correction value ΔVb is determined, the development bias Vb (Vb(current)) is determined by the following equation (4) (Step S9).

$$Vb(\text{current})=Vb(\text{initial})\times\Delta Vb \quad (4)$$

Next, the Vb(current) is subjected to an upper and lower limit treatment (Step S10). Specifically, when the Vb(current) is not less than the predetermined upper limit, the Vb(current) is set to the upper limit (i.e., Vb(max)). In contrast, when the Vb (current) is not greater than the predetermined lower limit, the Vb(current) is set to the lower limit (i.e., Vb(min)). After the upper and lower limit treatment, the thus obtained development bias Vb (current) is stored in the RAM 103 (Step S1). In this example, the Vb(max) and Vb(min) are 700V and 350V, respectively.

When the development bias Vb is changed, the charging bias Vc, at which the photoreceptor drum is charged, is changed using the following equation (5).

$$Vc=Vb+140[V] \quad (5)$$

wherein Vc represents the DC component of the charging bias.

The above-mentioned development potential correction operation is preferably performed at a time before the start of the present development operation is performed and after the completion of the last development operation is completed. By performing the development potential correction operation at such a frequency, each image can be produced while the development potential is set to a proper potential. Therefore, the image density of the produced images can be stabilized.

However, when the moving average of the image area proportion is dramatically changed (for example, a case where images with an image area proportion of about 0% are continuously produced and then solid images with an image area proportion of about 100% are produced), the deviance $\Delta\gamma$ of the development gamma characteristic $\gamma$ increases and therefore the correction value $\Delta Vb$ also increases. In such a case, it is possible that the development potential is gradually changed step by step. For example, when the correction value $\Delta Vb$ is 100V, the development potential is changed at a ratio of 10 V/10 pages or 20 V/20 pages. In addition, it is also possible to provide a limiter to set an upper limit for the correction value $\Delta$ Vb.

The correction of the development potential is not necessarily performed by adjusting the development bias, and can be performed by adjusting the potential of surface of the photoreceptor 11 and/or the energy of the laser beam, which is emitted by the optical writing unit for forming electrostatic latent images.

In the present example, similarly to the correction of the development potential, correction of the toner concentration target can also be performed on the basis of the replacement amount of the toner in the developing device 20 within a certain period of time (e.g., on the basis of the image area proportion of the images produced in the certain period of time). By using this method, the toner concentration can be properly controlled, and thereby the image density of the produced images can be controlled even when the replacement amount of the toner is largely changed. By combining the development potential correction with the toner concentration correction, the image density of the produced images can be controlled more stably.

Comparison Experiment

An experiment was performed to compare a case where the development bias correction operation is performed with a case where the development bias correction operation is not performed.

Figure 8:
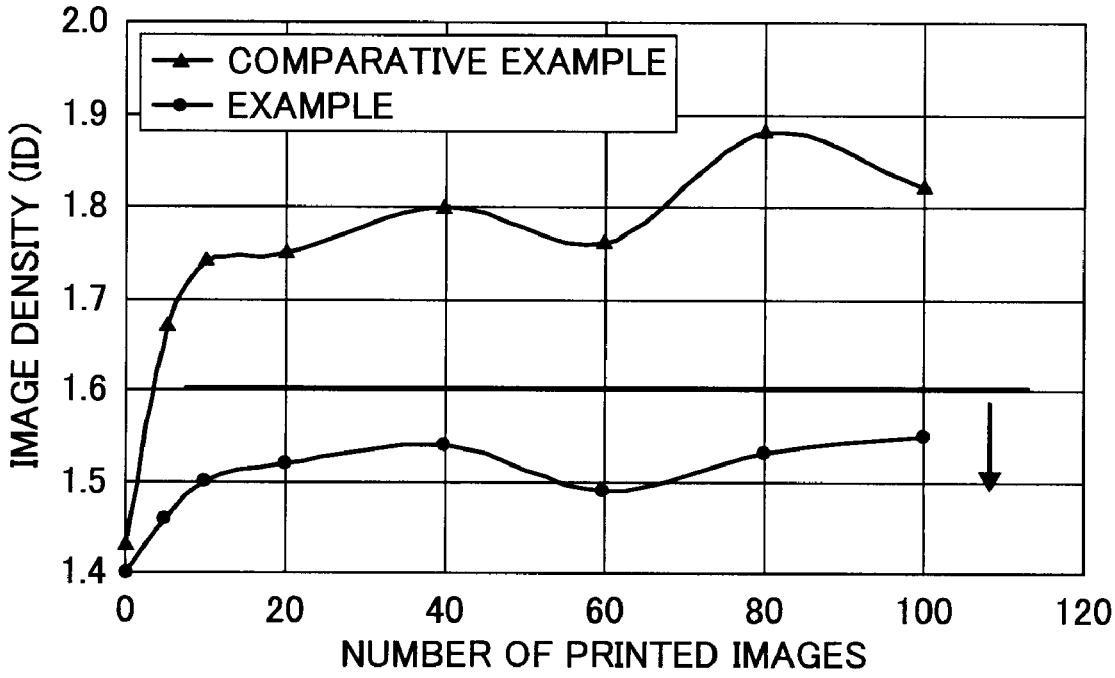
FIG. 8 is a graph illustrating changes of the image density of one hundred images produced in an example of the present invention and a comparative example.

FIG. 8 is a graph illustrating the results of the comparison experiment.

In this experiment, one hundred copies of an image with an image area proportion of 80% were produced using a laser printer at a normal linear speed mode of 138 mm/sec. The image densities of the produced images were measured. In FIG. 8, change of the image densities in a comparative example in which the development potential correction treatment is not performed is illustrated by a line formed by connecting triangle marks, and change of the image densities in an example in which the development potential correction treatment is performed is illustrated by a line formed by connecting circle marks. It is clear from FIG. 8 that the image density of the produced images increases and largely changes in the comparative example, but the image density is controlled so as to fall in a predetermined range (±0.2) in the example. Thus, it was confirmed that even when images with high image area proportion are produced and therefore the replacement amount of toner is large, the image density of the produced images can be stably controlled.

As mentioned above, the laser printer, which is an example of the image forming apparatus of the present invention, includes at least the following.

(1) the photoreceptor 11 serving as an electrostatic latent image bearing member;

(2) the developing device 20 including the developing sleeve 22 serving as a developer bearing member, which bears thereon a two component developer including a toner and a magnetic carrier and contacts the developer with the electrostatic latent image on the photoreceptor to form a toner image on the photoreceptor;

(3) the development bias power source 28 serving as the development potential forming device configured to form a development potential between the developing sleeve and the electrostatic latent image on the photoreceptor;

(4) the powder pump 27 serving as a toner replenishing device configured to supply the toner to the developing device;

(5) the magnetic permeability sensor 26 serving as a toner concentration detecting device configured to detect and output the concentration of the toner in the two component developer in the developing device; and (6) the controller 100 serving as a toner concentration controlling device, which compares the output Vt from the magnetic permeability sensor with the target $Vt_{ref}$ and controls the powder pump on the basis of the comparison data so that the output Vt approaches the $Vt_{ref}$, i.e., the toner concentration approaches the target of toner concentration.

In addition, the controller 100 serves as an information detecting device which obtains information (such as image area proportion) concerning the replacement amount of toner in the developing device within a predetermined period of time. Further, the controller 100 also serves as a correction device configured to adjust the development potential on the basis of the information (such as detection results of the image area proportion). Thus, the development ability of the developing device (i.e., the amount of toner adhered to an electrostatic images) can be controlled by adjusting the development potential (i.e., the difference in potential between the electrostatic latent image on the photoreceptor and the development bias applied to the developing sleeve). Therefore, the development ability (i.e., the amount of toner adhered to an electrostatic images) can be rapidly adjusted. Therefore, even when the toner replacement amount largely changes (for example, when images with a high image area proportion are produced), the image density of images can be stably controlled because the development potential is adjusted. Since the information concerning the toner replacement amount can be obtained without consuming the toner (i.e., without forming toner images), the development potential correction operation can be performed without consuming the toner.

In this example, the controller 100 serves as the information detecting device and determines the average of the image area proportion of the images produced in a predetermined period of time. Therefore, the information on the toner replacement amount can be easily obtained by a simple device without consuming the toner.

In this example, the controller 100 adjusts the development potential on the basis of the moving average of the image area proportion of the images produced in a predetermined period of time. Therefore, the history of the toner replacement amount for the last several images, which history is useful for determining the current characteristic of the developer, can be obtained. Accordingly, correction of the development potential can be performed more properly. Since the moving average (M(i)) can be calculated using the above-mentioned equation (1), only a small area of the RAM 103 is used for determining the moving average.

In this example, when the toner replacement amount is greater than the target amount, the controller 100 adjusts the development potential so as to decrease. In contrast, when the toner replacement amount is less than the target amount, the controller 100 adjusts the development potential so as to increase. Therefore, even in a case where images with a high image area proportion are produced and therefore the development gamma characteristic $\gamma$ increases, the development potential is decreased to decrease the development gamma characteristic $\gamma$. Accordingly, the image density can be easily controlled so as to fall in a predetermined range.

In addition, the controller 100 adjusts the development potential at an interval between the end of a developing operation of the developing device and the start of the next developing operation. Therefore, each image is produced while controlling the development potential.

Further, the controller 100 adjusts the development potential step by step so that the development potential falls in the predetermined range. Use of this method prevents occurrence of an image density changing problem in that the image density rapidly changes, for example, when images with a high image area proportion are produced after production of images with a low image area proportion (i.e., when the moving average of the image area proportion is largely changed).

This document claims priority and contains subject matter related to Japanese Patent Application No. 2006-141920, filed on May 22, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a latent image bearing member configured to bear an electrostatic latent image thereon;

a developing device configured to develop the latent image with a two-component developer including a toner and a magnetic carrier, wherein the developing device includes a developer bearing member bearing the two-component developer on a surface thereof;

a development potential forming device configured to form a development potential between the electrostatic latent image on the image bearing member and the developer bearing member;

a toner replenishing device configured to supply the toner to the developing device;

a toner concentration detecting device configured to detect and output a concentration of the toner in the two-component developer in the developing device;

a toner concentration controlling device configured to compare the toner concentration output with a toner concentration target to control the toner concentration so as to approach the toner concentration target;

an information detecting device configured to obtain information to determine a replacement amount of the toner in the developing device in a predetermined period of time; and a development potential correcting device configured to adjust the development potential on the basis of the information obtained by the information detecting device.

2. The image forming apparatus according to claim 1, wherein the information obtained by the information detecting device is an image area proportion of images formed in a predetermined period of time.

3. The image forming apparatus according to claim 2, wherein the development potential correcting device adjusts the development potential on the basis of an average of the image area proportion of the images formed in the predetermined period of time.

4. The image forming apparatus according to claim 2, wherein the development potential correcting device adjusts the development potential on the basis of a moving average of the image area proportion of the images formed in the predetermined period of time.

5. The image forming apparatus according to claim 4, wherein the moving average is determined by the following equation (1):

$$M(i)=(1/N)\times\{(M(i-1)\times(N-1)+X(i)) \quad (1)$$

wherein M(i) represents a present value of the moving average of the image area proportion; M(i−1) represents a last value of the moving average; N represents a cumulative number of the images produced in the predetermined period of time; and X(i) represents the image area proportion of a present image.

6. The image forming apparatus according to claim 1, wherein when the replacement amount of the toner in the developing device is greater than a predetermined amount, the development potential correcting device decreases the development potential, and when the replacement amount of the toner in the developing device is less than the predetermined amount, the development potential correcting device increases the development potential.

7. The image forming apparatus according to claim 1, wherein the development potential correcting device adjusts the development potential at a time between an end of a developing operation of the developing device and a start of a next developing operation.

8. The image forming apparatus according to claim 1, wherein the development potential correcting device adjusts the development potential step by step so that the development potential approaches a development potential target.

9. The image forming apparatus according to claim 1, wherein the toner concentration detecting device is a magnetic permeability sensor configured to measure a magnetic permeability of the two-component developer to determine the concentration of the toner therein.

10. An image forming method comprising:

forming an electrostatic latent image on an image bearing member;

developing the electrostatic latent image with a two-component developer including a toner and a magnetic carrier using a developer bearing member while applying a development potential between the electrostatic latent image on the image bearing member and the developer bearing member determining a concentration of the toner in the two-component developer;

comparing the toner concentration with a toner concentration target;

controlling the toner concentration on the basis of the comparison result so as to approach the toner concentration target;

obtaining information to determine a replacement amount of the toner in the developer; and adjusting the development potential on the basis of the information.

11. The image forming method according to claim 10, wherein the information in the information obtaining step is an image area proportion of images formed in a predetermined period of time.

12. The image forming method according to claim 11, wherein the development potential correcting step comprises:

adjusting the development potential on the basis of an average of the image area proportion of the images formed in the predetermined period of time.

13. The image forming method according to claim 11, wherein the development potential correcting step comprises:

adjusting the development potential on the basis of a moving average of the image area proportion of the images formed in the predetermined period of time, wherein the moving average is determined by the following equation (1):

$$M(i)=(1/N)\times\{(M(i-1)\times(N-1)+X(i)) \quad (1)$$

wherein M(i) represents a present value of the moving average of the image area proportion; M(i−1) represents a last value of the moving average; N represents a cumulative number of the images produced in the predetermined period of time; and X(i) represents the image area proportion of a present image.

14. The image forming method according to claim 10, further comprising:

comparing the replacement amount of the toner with a predetermined amount, wherein the development potential correcting step comprises:

decreasing the development potential when the replacement amount of the toner is greater than the predetermined amount, and increasing the development potential when the replacement amount of the toner is less than the predetermined amount.

15. The image forming method according to claim 10, wherein the development potential adjusting step comprises:

adjusting the development potential on the basis of the information at a time between an end of a developing operation of the developing device and a start of a next developing operation.

16. The image forming method according to claim 10, wherein the development potential adjusting step comprises:

adjusting the development potential step by step on the basis of the information so that the development potential approaches a development potential target.

* * * * *